US010869116B2

(12) United States Patent
O'Callaghan

(10) Patent No.: US 10,869,116 B2
(45) Date of Patent: Dec. 15, 2020

(54) EARPHONE

(71) Applicant: Mark William O'Callaghan, London (GB)

(72) Inventor: Mark William O'Callaghan, London (GB)

( * ) Notice: Subject to any disclaimer, the term of this patent is extended or adjusted under 35 U.S.C. 154(b) by 102 days.

(21) Appl. No.: 16/333,246

(22) PCT Filed: Sep. 14, 2016

(86) PCT No.: PCT/GB2016/052834
§ 371 (c)(1),
(2) Date: Mar. 14, 2019

(87) PCT Pub. No.: WO2018/051050
PCT Pub. Date: Mar. 22, 2018

(65) Prior Publication Data
US 2019/0253783 A1 Aug. 15, 2019

(51) Int. Cl.
*H04R 25/00* (2006.01)
*H04R 1/10* (2006.01)
*H04R 1/34* (2006.01)

(52) U.S. Cl.
CPC ..... *H04R 1/1016* (2013.01); *H04R 1/1058* (2013.01); *H04R 1/1083* (2013.01); *H04R 1/345* (2013.01); *H04R 1/1041* (2013.01); *H04R 2460/13* (2013.01)

(58) Field of Classification Search
CPC .. H04R 1/1016; H04R 1/1041; H04R 1/1058; H04R 1/1083; H04R 1/345; H04R 2460/13; H04R 1/323
USPC ..... 381/338
See application file for complete search history.

(56) References Cited

U.S. PATENT DOCUMENTS 2,487,038 A * 11/1949 Baum ..... H04R 1/1016 181/135
4,443,668 A 4/1984 Warren
4,540,063 A * 9/1985 Ochi ..... A61F 11/08 128/867
7,356,156 B2 * 4/2008 R egg ..... H04R 1/1066 381/374

(Continued)

FOREIGN PATENT DOCUMENTS

CN 204 014 070 U 12/2014
KR 101 473 474 B1 1/2015

OTHER PUBLICATIONS

International Search Report and Written Opinion dated Jun. 26, 2017.

*Primary Examiner* — Phylesha Dabney
(74) *Attorney, Agent, or Firm* — Fresh IP PLC; Clifford D. Hyra; Aubrey Y. Chen

(57) ABSTRACT

An earphone comprises an acoustic waveguide (305), for coupling sound waves from an acoustic transducer into an ear (5), the waveguide having an outer end (315) and an inner end (320), at least the inner end being open. The acoustic transducer (310) is arranged at the outer end (315) of the acoustic waveguide and the inner end (320) of the acoustic waveguide is configured to be located in the ear (5). The acoustic waveguide (305) has a neck (340) between the outer end (315) and the inner end (320), and has a cross section at the neck that is smaller than a cross section at each of the outer end and the inner end.

33 Claims, 7 Drawing Sheets

(56) References Cited

U.S. PATENT DOCUMENTS

| | | | | |
|---|---|---|---|---|
| 7,697,706 | B2 * | 4/2010 | Doty | A61F 11/08 381/328 |
| 9,578,412 | B2 * | 2/2017 | Azmi | H04R 1/1091 |
| 2012/0057739 | A1 * | 3/2012 | Smith | H04R 1/1008 381/379 |
| 2019/0208304 | A1 * | 7/2019 | Cohen | H04R 1/1075 |
| 2020/0221201 | A1 * | 7/2020 | Zalisk | H04R 1/1058 |
| 2020/0252711 | A1 * | 8/2020 | Smith | H04R 1/105 |

* cited by examiner

EARPHONE

FIELD OF THE INVENTION

This invention relates to earphones, also known as in-ear monitors.

BACKGROUND OF THE INVENTION

An earphone or in-ear monitor is a type of headphone in which at least a part of the device is designed to be inserted in the human ear. Because they sit partly inside the ear, comfort is an important consideration for earphones. And, as with all headphones, it is also desirable to provide high quality audio reproduction.

Custom in-ear monitors are known, in which the exterior surface of the ear bud is customised to fit an individual user's ear. This may require an impression to be taken of the ear. The part of the earphone that fits into the ear is then moulded or shaped to match the impression. This customisation can increase comfort for the wearer, because the outer surface of the earphone follows the particular contours of their ear.

A brief summary of the anatomy of the ear will now be provided, with reference to FIGS. 1 and 2. The external ear consists of the auricula (or pinna) and the external acoustic meatus (or ear canal) 40. The helix 12 is the rim of the auricula. A second curved feature, called the antihelix 16 is approximately parallel to and forward of the helix 12. At its upper end, the antihelix 16 divides into an inferior (anterior) crus 24 and a superior (posterior) crus 26. Between these is a depression called the triangular fossa 27. The scapha 28 is a narrow depression between the helix 12 and antihelix 14. Forward of the antihelix 16 there is defined a cavity called the concha 30, which is partially divided by the crus helix 14 into an upper part, the cymba conchae 34, and a lower part, the cavum conchae 32. Forward of the cavum 32, the tragus 22 projects backward over the ear canal 40. The antitragus 20 is opposite the tragus 22 to the rear. Between these is defined the incisura anterior auris (or intertragic notch) 18. The ear lobe 10 is below this. As seen in FIG. 2, the ear canal 40 extends from the bottom of the concha 30 to the tympanic membrane (or eardrum) 75. The ear canal 40 forms an S-shaped curve, extending first inward, forward and slightly upward; then, after the first bend 60, inward and backward; and finally inward, forward, and slightly downward. It is formed partly by cartilage 65 and partly by bone 50, lined with a thin layer of skin. In the inner ear, the cochlea 70 is a conical, spiral-shaped, hollow chamber of bone. The cochlea 70 comprises the sensory organ for hearing. Here, acoustic vibrations sensed to produce the perception of sound. The skin inside the inner ear is the thinnest on the body. The cochlea 70 is filled with around 18,000 minute hairs, which transmit electrical impulses to the brain to produce the sensation of hearing. Loud noise can damage these hairs, which may be permanent. This causes hearing loss and tinnitus.

SUMMARY OF THE INVENTION

The invention is defined by the claims.

According to one aspect, there is provided an earphone, comprising:

an acoustic transducer; and an acoustic waveguide, for coupling sound waves from the acoustic transducer into an ear, the waveguide having an outer end and an inner end, at least the inner end being open, wherein the acoustic transducer is arranged at the outer end of the acoustic waveguide and the inner end of the acoustic waveguide is configured to be located in the ear, and wherein the acoustic waveguide has a neck between the outer end and the inner end, the acoustic waveguide having a cross section at the neck that is smaller than a cross section at each of the outer end and the inner end.

The present inventor has recognised that there remains a need for improved audio quality, and that this may be addressed by optimising an internal shape of the earphone, rather than just its external shape. According to embodiments, the shape of the acoustic waveguide is designed to improve the coupling of sound waves (acoustic vibrations) from a transducer into the ear of the wearer. This improved coupling may result in less attenuation of the sound (perceived as enhanced volume), better fidelity of audio reproduction (perceived as a sense of being an immersive audio experience similar to a live audio experience), or both.

The cross section may be taken in a plane perpendicular to an axis of the waveguide that connects the open ends. This axis may be curved, if the waveguide is curved.

The size of the cross section of the waveguide may be defined by its maximum linear dimension, its minimum linear dimension, or its area. Typically, all of these measures will all be correlated.

The acoustic waveguide is preferably a hollow cavity filled with air. The size of the cross section at a given position between the outer end and the inner end represents the amount of space in the cavity, at that position.

The outer end of the acoustic waveguide may also be open, in addition to the inner end.

The acoustic transducer may be a speaker. The speaker may comprise a diaphragm, which faces the outer end of the acoustic waveguide. A space behind the diaphragm is preferably in fluid communication with the air outside the ear. In particular, the earphone may comprise a cover at the back of the speaker and air holes may be provided in this cover. This may allow greater movement of the diaphragm than a sealed enclosure.

The neck defines a constriction in the cross section of the acoustic waveguide. The acoustic waveguide preferably has its smallest cross section at the neck. The outer end of the waveguide is typically larger in cross section than the inner end.

The acoustic waveguide is preferably tapered between the outer end and the neck, and is tapered between the inner end and the neck.

Here, tapered means a gradually reducing cross section. The acoustic waveguide is tapered between the outer end and the neck, and flared between the neck and the inner end. Flared means a gradually expanding cross section. The tapering (or flaring, respectively) is preferably smooth and, in particular, the inner surface of the acoustic waveguide is preferably a smooth curved surface—for example, it does not exhibit any corners or edges. The acoustic waveguide may therefore have a three dimensional shape that can be approximated by an hourglass shape.

The acoustic waveguide preferably comprises a cylindrical portion located between the outer end and the neck. The cross-section of the acoustic waveguide is constant throughout the cylindrical portion. The acoustic waveguide may comprise non-cylindrical portions before the cylindrical portion or after the cylindrical portion or both. The non-cylindrical portions before and/or after the cylindrical portion may be tapered. The cylindrical portion preferably starts at the outer end of the acoustic waveguide. Therefore, there is no portion of the acoustic waveguide before the cylindrical portion along the axis from the outer end to the inner end.

The acoustic waveguide preferably includes a bend.

The neck is preferably located at the bend.

The earphone may comprise a body formed of polymer material, and wherein the acoustic waveguide comprises a cavity in the polymer material.

At least part of the body may be configured to be inserted in the ear. An outer surface of the body may be shaped to engage with the ear.

The acoustic waveguide may be formed by the cavity, which may be defined by an inner surface of the body.

The thickness of the body, between the inner surface and outer surface, is typically non-uniform.

The acoustic transducer is preferably mounted to an outer portion of the body.

The body may comprise: a middle portion located inwardly of the outer portion; a bend portion located inwardly of the middle portion; and an inner portion located inwardly of the bend portion.

Here, outer, middle, and inner refer to positions with respect to the ear. "Inwardly" means closer to the ear or further inside the ear.

The bend portion may be configured to engage with the first bend in a human ear.

The inner portion is preferably configured to engage with the ear canal (the external acoustic meatus) inwardly of the first bend of the ear. The inner portion may be configured to engage with one or more (or all) of: the cartilaginous external acoustic meatus, the cavum, or the bony external acoustic meatus.

Engagement of the inner portion with the wall of the ear canal may help to promote solid conduction of acoustic vibrations into the ear, also known as "bone conduction". The vibrations may be conducted from the inner portion of the earphone-body to the wall of the ear canal, from there via skin or cartilage to the temporal bone (the base of the skull), and from the temporal bone to the cochlea (inner ear).

The bend of the acoustic waveguide is preferably formed in the bend portion of the body.

Preferably, therefore, the neck of the acoustic waveguide is located in the bend portion of the body.

The body optionally further comprises a protruding lobe for engaging with the cymba (cymba conchae) of a human ear.

The lobe may project from the outer portion of the body, inwardly, above and/or to the rear of the cavity forming the acoustic waveguide.

The body may be formed of polymer material having different hardness at different portions of the body.

At least one of the following conditions, or any combination of two or more of the following conditions, may be met: the outer portion is harder than each of the middle portion, the bend portion, and the inner portion; the inner portion is softer than each of the outer portion, the middle portion, and the bend portion; the middle portion is harder than the bend portion.

A harder outer portion may provide greater rigidity. A softer inner portion may facilitate solid conduction of acoustic vibrations to the wall of the ear canal (promoting bone conduction). Gradually decreasing hardness, from the outer portion to the inner portion may improve solid conduction of acoustic vibrations to the inner portion (and from there to the wall of the ear canal). This may also provide more comfort to the wearer.

Hardness may be determined by Shore durometer, using Shore A scale.

Preferably, the outer portion has a Shore durometer in the range greater than or equal to 30 and less than or equal to 50. Preferably, the middle portion has a Shore durometer in the range greater than or equal to 20 and less than or equal to 30. Preferably, the bend portion has a Shore durometer in the range greater than or equal to 10 and less than or equal to 20. Preferably, the inner portion has a Shore durometer in the range greater than or equal to 6 and less than or equal to 10.

In other embodiments, the outer portion has a Shore durometer in the range greater than or equal to 25 and less than or equal to 50. Preferably, the middle portion has a Shore durometer in the range greater than or equal to 15 and less than or equal to 25. Preferably, the inner portion has a Shore durometer in the range greater than or equal to 8 and less than or equal to 15.

The polymer material preferably comprises silicone.

Further provided is a pair of earphones comprising a left earphone and a right earphone, each as summarised above, the shape of the acoustic waveguide in the left earphone being a mirror image of the shape of the acoustic waveguide in the right earphone, wherein the body of the left earphone is not a mirror image of the body of the right earphone.

If a wearer has left and right ears of different shapes or sizes then the exterior surface of the body of each earphone should be shaped to match the respective ear. However, in order to create a balanced perception of sound it may be beneficial for the acoustic waveguides to be substantially identical in both earphones (such that the right waveguide is a mirror image of the left waveguide). In order to ensure a satisfactory fit, the substantially identical acoustic waveguides may be formed based on the measurements of the smaller of a user's two ear canals.

According to another aspect there is provided a method of manufacturing an earphone as summarised above, the method comprising the steps of:

(i) determining the shape of an individual user's ear canal; and (ii) manufacturing the body of the earphone so that at least a part of the exterior of the body is substantially identical to said determined shape.

Preferably, the entire exterior of the body is substantially identical to the determined shape of the ear.

The step (ii) of manufacturing the body may comprise sizing the inner end of the body so that it is smaller than the size of a corresponding cross-section of the individual user's ear canal in which the inner end of the body lies when the earphone is worn by the individual user, such that the inner end of the body does not contact the skin of the individual user's ear canal.

The inner end of the body may preferably be sized to be between 50% and 99% of the size of the corresponding cross-section of the individual user's ear canal.

The inner end of the body may be sized so that it is smaller than the size of the smallest cross section of the portion of the user's ear canal in which the body lies when the earphone is worn by the individual user. The inner end of the body may preferably be sized to be between 50% and 99% of the size of the smallest cross section.

The inner end of the body is preferably sized such that the outer surface of the body between the inner end and the bend does not contact the skin of the individual user's ear canal.

A pair of earphones may be manufactured by applying the above described method of manufacturing an earphone to produce a left earphone for the individual user's left ear canal and a right earphone for the individual user's right ear canals.

The shape of the acoustic waveguide for both of the earphones may be formed based on the smaller of the individual user's left and right ear canals.

The size of the inner ends of the body of both earphones may be the same. The inner ends of the body of both earphones may be sized to be between 50% and 99% of the size of the corresponding cross-section of the smaller of the individual user's left and right ear canals.

The inner ends of the body of both earphones may be sized so that they are smaller than the size of the smallest cross section of the portions of both of the user's ear canals in which the body of each earphone lies when the pair of earphones are worn by the individual user.

The inner ends of the body of both earphones may be sized to be between 50% and 99% of the size of the smallest cross section. The inner ends of the body of both earphones may be sized such that the outer surface of the body between the inner end and the bend of each earphone does not contact the skin of the individual user's respective ear canal. The step (i) of determining the shape may comprise at least one of: a 3D scan; and taking an impression of the ear.

The step (ii) of manufacturing the body optionally comprises at least one of: 3D printing a mould for moulding the polymer material; and 3D printing the polymer material.

3D printing can be used to directly shape the polymer material into the desired custom shape to fit in the ear. Alternatively, 3D printing can be used to shape a mould, and the mould can then be used to cast the polymer material to make the body in the desired custom shape.

The method may further comprise: determining the largest size of acoustic transducer that will fit the ear, based on the shaped determined in step (i); and manufacturing the earphone using an acoustic transducer of said largest size.

The acoustic transducer—for example, speaker—that is used in the earphone may be configured to fit in a space defined by the combination of the concha and incisura (intertragic notch) of the ear. In general, the larger the transducer, the better the earphone is able to generate acoustic vibrations and couple them (via air conduction and/or solid conduction) to the ear. Thus, the quality of audio reproduction may be increase with increasing transducer size.

According to another aspect, there is provided a kit of parts for assembly into an earphone as summarised above. The kit may comprise a first part and a second part. The first part houses the acoustic transducer and defines a first portion of the acoustic waveguide which includes the outer end of the acoustic waveguide. The second part defines a second portion of the acoustic waveguide including the inner end. The first portion of the acoustic waveguide defined by the first part may include the cylindrical portion summarised above. The kit may further comprise a third part for engaging with the outer ear of a wearer. Whilst the third part does not define part of the acoustic waveguide, it helps to secure the earphone in place when in use.

BRIEF DESCRIPTION OF THE DRAWINGS

The invention will now be described by way of example with reference to the accompanying drawings, in which.

Figure 1:
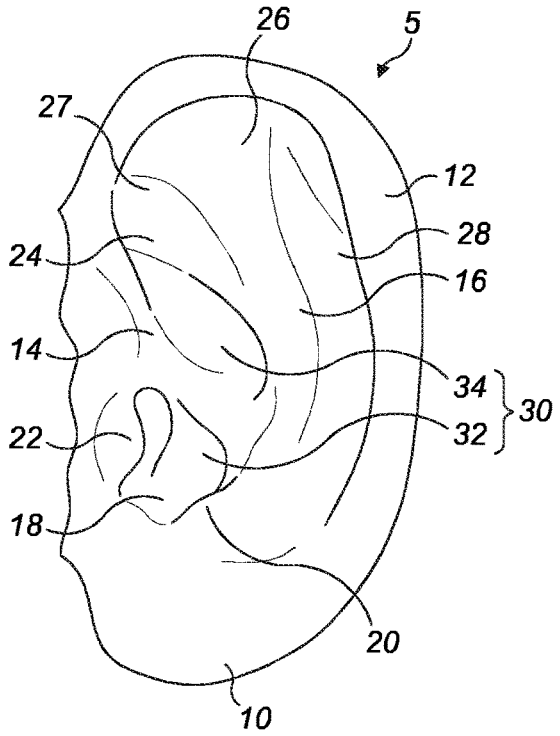
FIG. 1 illustrates the external anatomy of the ear.
Figure 2:
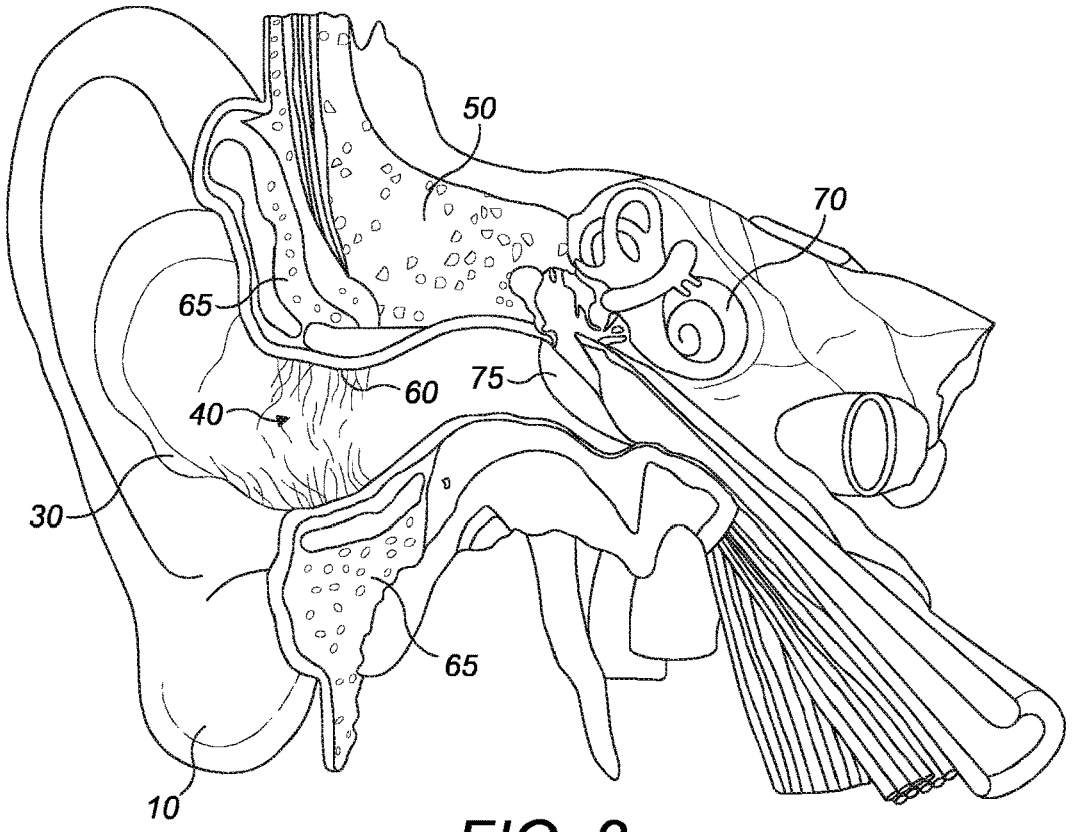
FIG. 2 is a cutaway diagram illustrating the external and internal anatomy of the ear.
Figure 3:
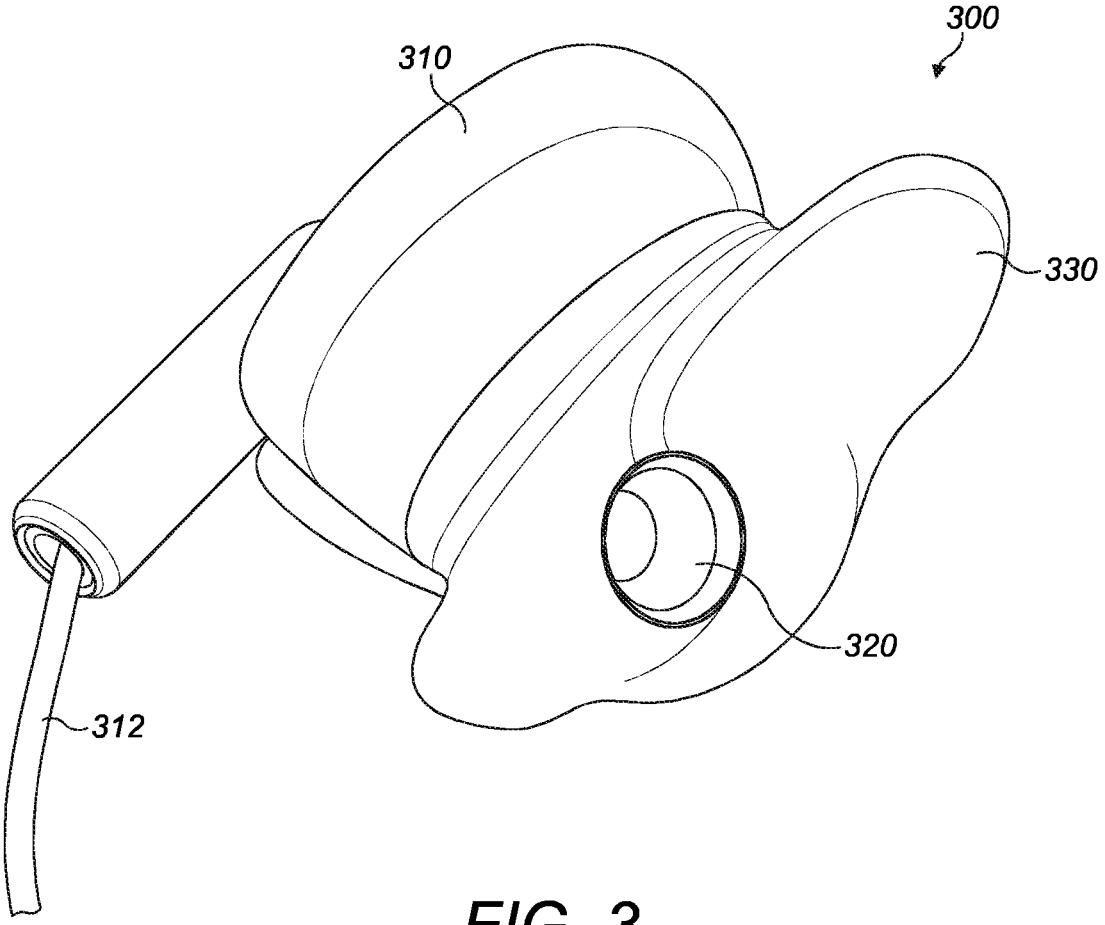
FIG. 3 shows a right earphone according to an embodiment.
Figure 4:
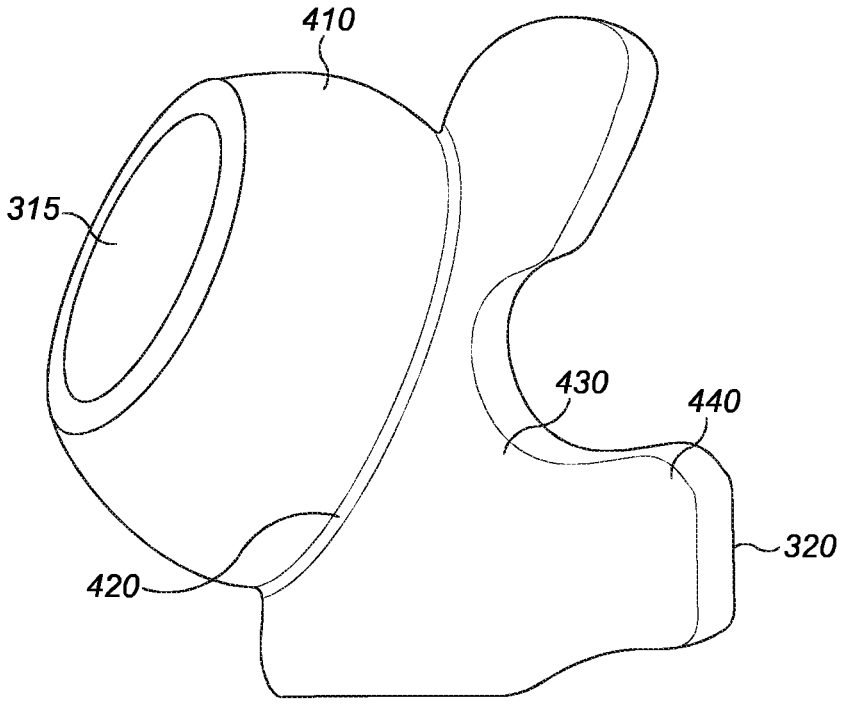
FIG. 4 shows the silicone body of a right earphone according to an embodiment, from a front view.
Figure 5:
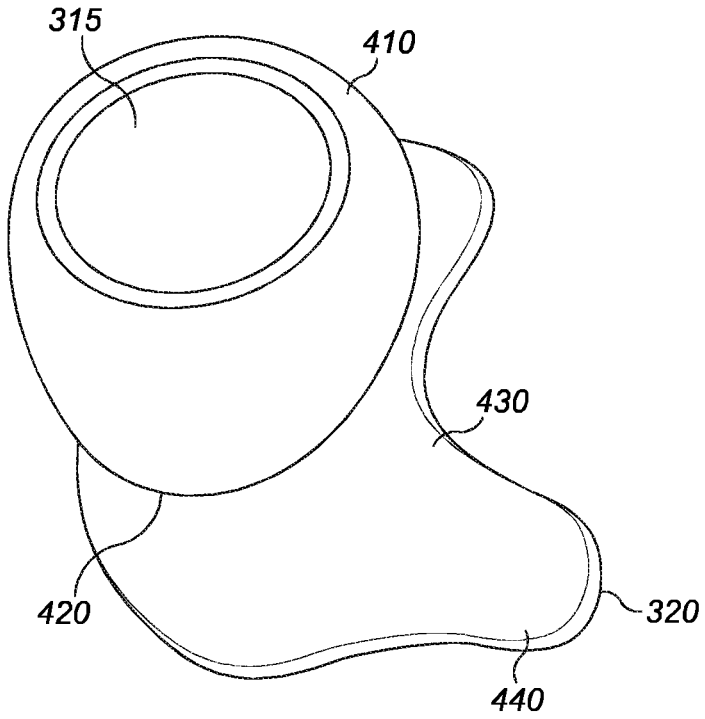
FIG. 5 shows the silicone body of FIG. 4, from a side view.
Figure 6:
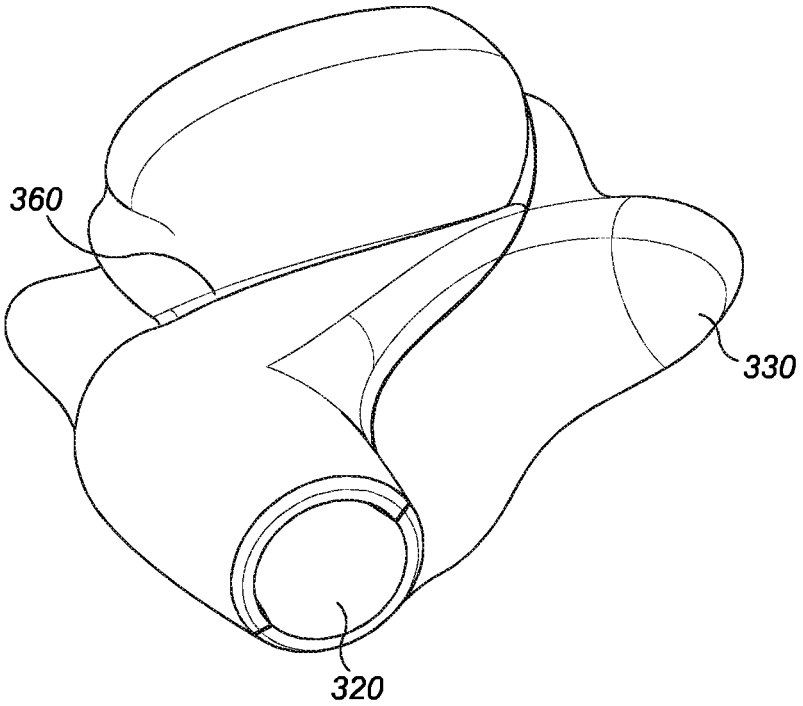
FIG. 6 is a view from the opposite side to FIG. 5.

It should be noted that these figures are schematic and not necessarily drawn to scale. Relative dimensions and proportions of parts of these figures have been shown exaggerated or reduced in size, for the sake of clarity and convenience in the drawings.

DETAILED DESCRIPTION

Exemplary earphones according to an embodiment will now be described, with reference to FIGS. 3-11. The earphone 300 comprises an acoustic transducer 310, which in this embodiment is a speaker. Electrical signals are delivered to the speaker by a cable 312 and the speaker converts the electrical signals into acoustic vibrations. The earphone couples these vibrations into the ear of a wearer. In particular, the earphone comprises an acoustic waveguide 305, which is an air-filled cavity for coupling sound waves from the speaker into the ear. This waveguide 305 has an inner end 320 that is shaped and arranged to fit into the ear 5. An outer end 315 of the waveguide 305 is coupled to the acoustic transducer 310. Sound waves generated by the transducer 310 travel through the air inside the acoustic waveguide 305 to enter the ear canal 40. This transmission of sound waves into the ear using air as the medium is referred to as air conduction.

Figure 7:
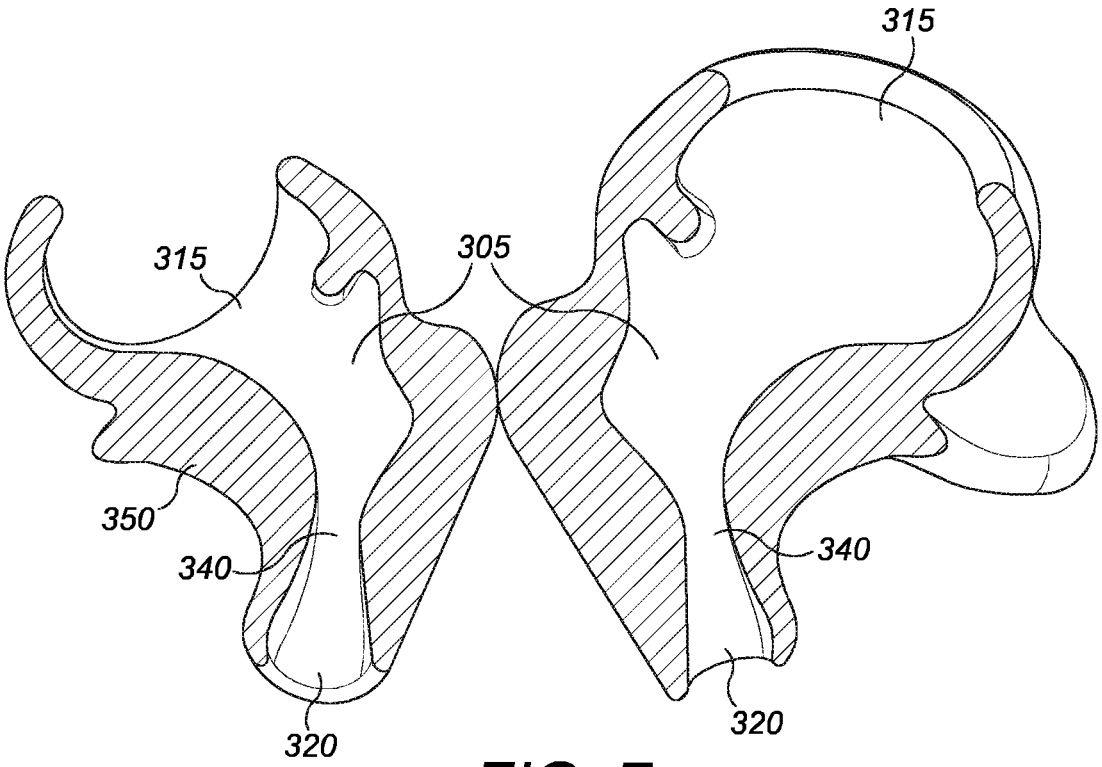
FIG. 7 shows the two halves of the earphone of FIGS. 4-6 in cross section.
Figure 8:
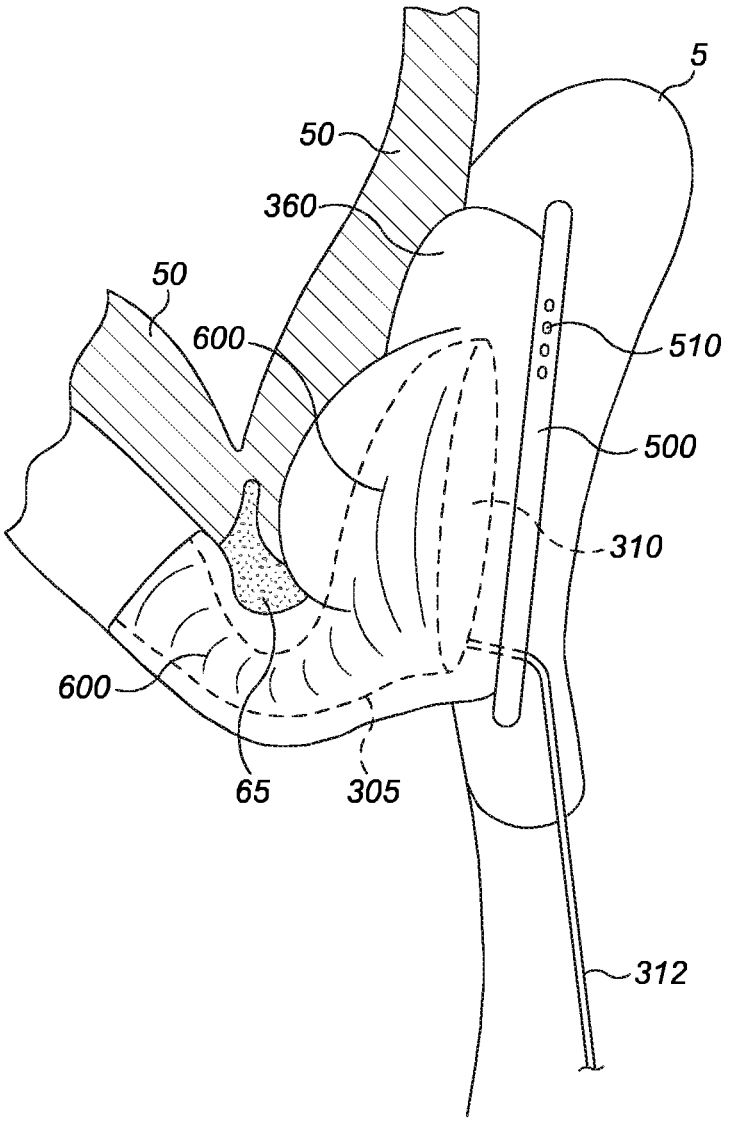
FIG. 8 is a schematic diagram illustrating an earphone according to an embodiment in cross section, in place in the ear.
Figure 9:
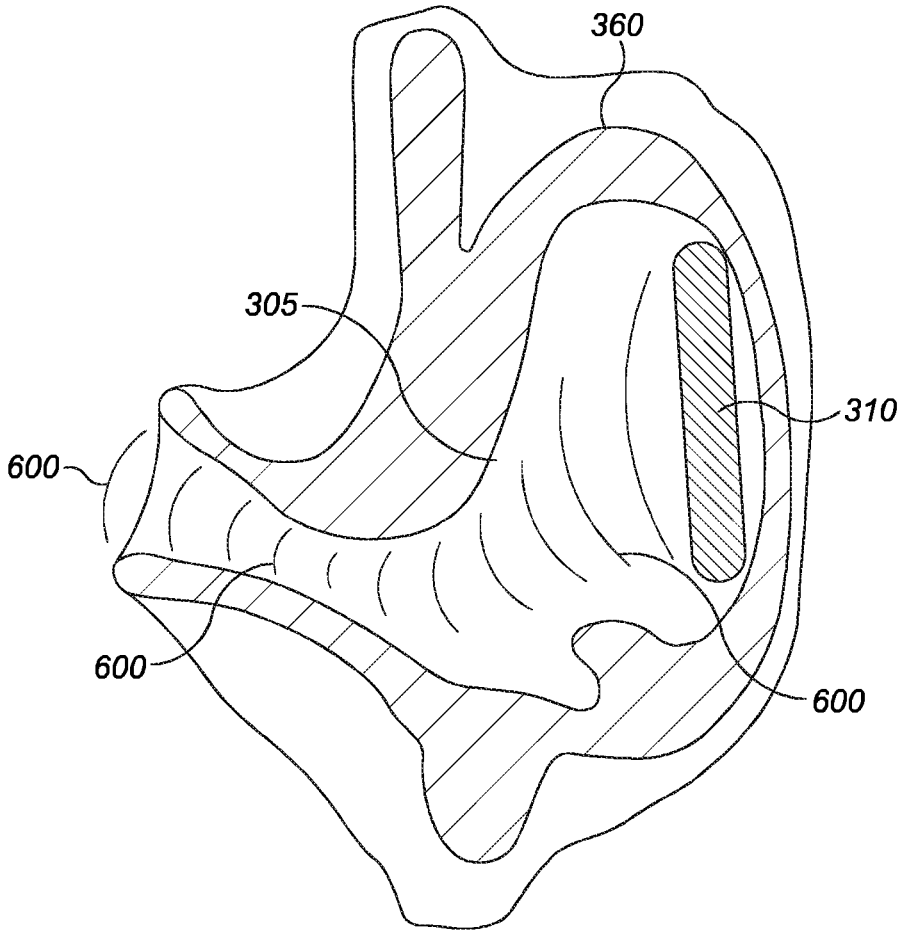
FIG. 9 is a schematic diagram illustrating the propagation of sound waves through the acoustic waveguide of an earphone according to an embodiment.

The acoustic waveguide 305 has a neck 340 between its outer end 315 and inner end 320. The cross section of the waveguide at the neck 340 is smaller than its cross section at the outer end 315 and is also smaller than its cross section at the inner end 320. In particular, the cross sectional area of the cavity forming the waveguide 305 is large at the outer end 315, small at the neck 320 and medium sized at the inner end 320. The acoustic waveguide 305 is tapered between the outer end 315 and the neck 340 and is also tapered between the inner end 320 and the neck 340. In particular, the cross sectional area of the waveguide 305 becomes gradually smaller, moving along a longitudinal axis of the waveguide from the outer end 315 to the neck 340. Similarly, the cross sectional area decreases gradually moving along the longitudinal axis from the inner end 320 to the neck 340. Thus, the neck 340 is the narrowest part of the waveguide 305 and has the smallest cross sectional area. By tapering gradually, the shape of the waveguide 305 avoids sharp discontinuities, such as corners or edges, which might cause unwanted reflection of sound waves. As illustrated in FIGS. 7-9, the waveguide 305 has a bend 350, where the neck 340 is located. The shape of the acoustic waveguide 305 can therefore be considered as somewhat similar to an hourglass or to two conical segments coupled together at their narrow ends, with a bend located at or near the narrowest point.

In an alternative embodiment (not illustrated), the acoustic waveguide comprises a cylindrical portion starting at the outer end of the acoustic waveguide and being located between the outer end and the neck of the acoustic waveguide.

Figure 10:
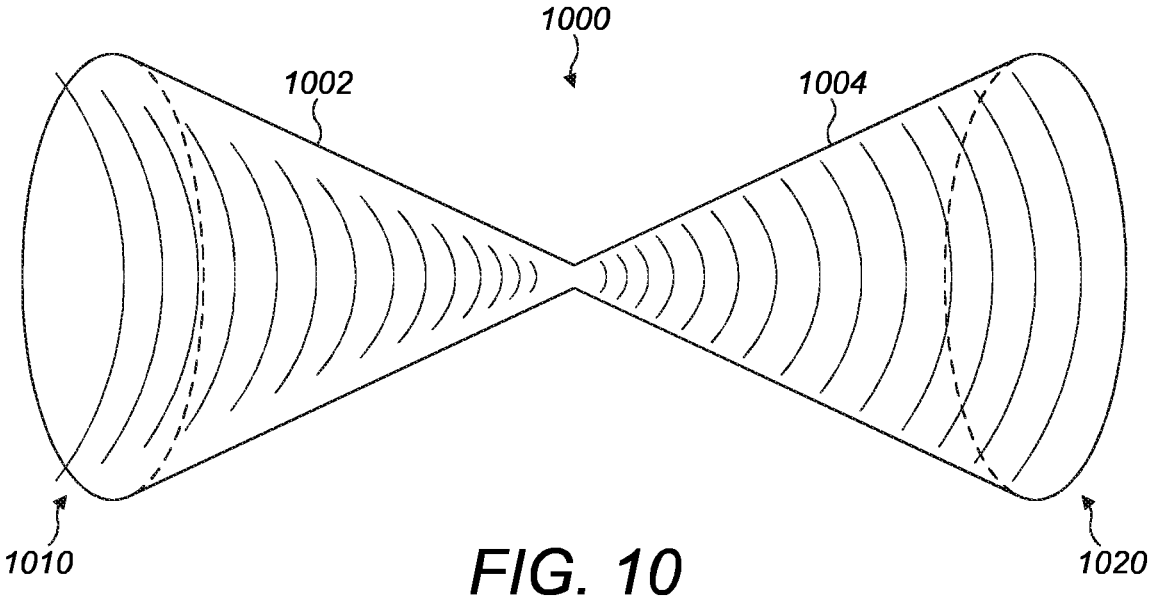
FIG. 10 illustrates the principle of the acoustic waveguide in simplified terms.
Figure 11:
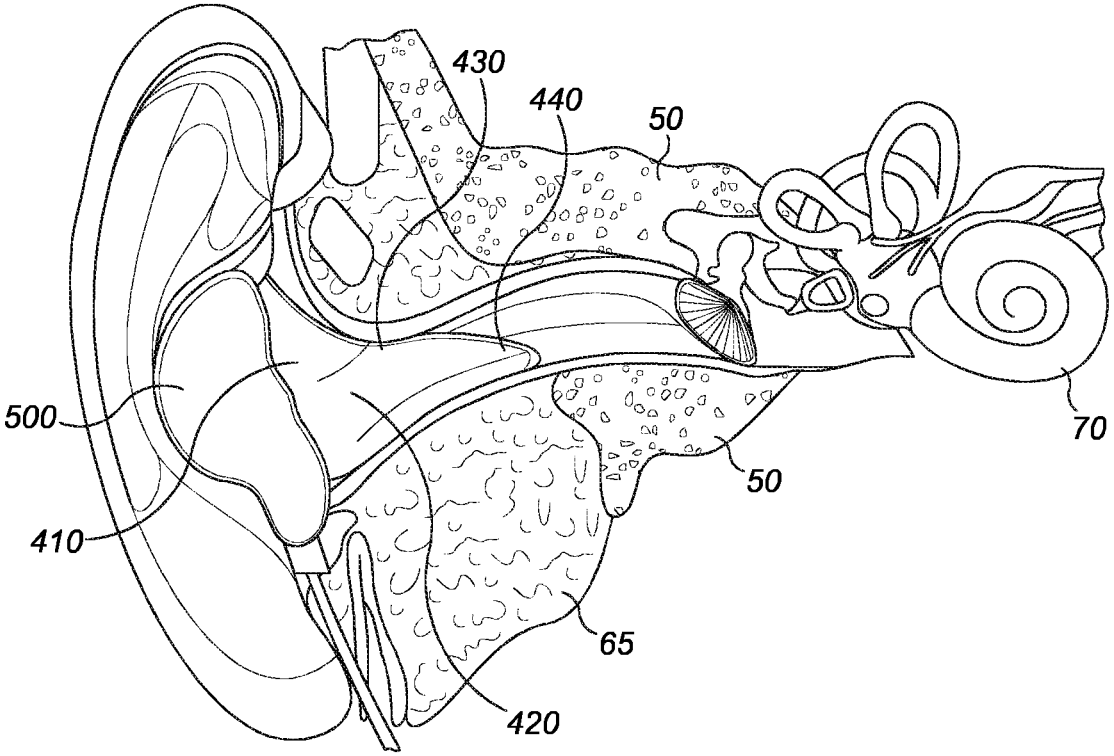
FIG. 11 is a cutaway drawing showing schematically how an earphone according to an embodiment engages with a wearer's ear.

FIG. 10 illustrates, in simplified, schematic form, the principle by which sound waves are believed to propagate in the acoustic waveguide 305. The simplified waveguide model 1000 of FIG. 10 consists of two conical segments 1002 and 1004, coupled at their narrow ends. Without wishing to be bound by theory, it is believed that audio waves 1010 entering the first cone 1002 are "compressed" down to the narrowest part of the waveguide and then expand again to emerge from the second cone 1004 in a form substantially identical to that of the audio waves that entered. It is believed that this occurs through the mechanism of diffraction. Similarly, in the real waveguide 305, the sound waves are believed to diffract around the bend 350 at the neck 340. Thus, without wishing to be bound by theory, it is believed that the acoustic wave front is always traveling in a direction approximately parallel to a curved longitudinal axis, from the outer end 315 of the waveguide 305 to the inner end 320, via the neck 340. This is illustrated in FIG. 9.

The inclusion of a cylindrical portion between the outer end and the neck of the acoustic waveguide is believed to have the effect of forming a resonance chamber. Without wishing to be bound by theory, it is believed that such a resonance chamber may amplify partial reflections within the waveguide using resonance, thereby mimicking the way in which many sounds, such as the human voice and various musical instruments, are naturally produced and may increase bone conduction. The inclusion of the resonance chamber is therefore believed to add a more realistic depth to the sound experienced by the user of the earphone.

The exterior surface of the earphone body 360 is best seen in FIGS. 3-6. In this embodiment, the body 360 of the earphone is formed of a polymer material—specifically, silicone. The acoustic waveguide 305 is formed by a cavity in the silicone. Thus, the inner surface of the body 360 defines the shape of the waveguide 305. The acoustic transducer 310 is joined to the body 360 at an outer portion 410 of the body. The silicone of the outer portion 410 may be moulded to engage with the transducer 310 and the transducer 310 may have projections or clips (not shown) to facilitate secure engagement with the moulded silicone. It may be advantageous for the silicone of the outer portion to be relatively thick. This is believed to facilitate strong coupling of vibrations from the transducer 310 into the solid material of the body 360 and into the air space of the waveguide 305. The outer portion 410 is formed of relatively hard silicone, having a Shore A hardness in the range 30 to 50. The body 360 also has a middle portion 420 located directly inwardly of the outer portion; a bend portion 430, located directly inwardly of the middle portion 420; and an inner portion 440, located directly inwardly of the bend portion 430. These portions use successively softer grades of silicone. The middle portion has a Shore A hardness in the range 20 to 30. The silicone in the bend portion has a Shore A hardness in the range 10 to 20. The silicone of the inner portion 440 is the softest—having a Shore A hardness in the range 6 to 10. It is believed that, by providing relatively more rigid silicone toward the outer portion 410 of the body 360 and relatively softer, more flexible silicone toward the inner portion 440 of the body 360, the transmission of acoustic vibrations can be improved. In particular, it is believed that this may facilitate solid conduction of acoustic vibrations through the inner portion 440 of the body 360 to the walls of the ear canal 40, which are in direct contact with the inner portion 440. Such vibrations can be delivered through the thin layer of skin to either the cartilage 65 or the temporal bone 50, or both. The vibrations can then be transmitted to the cochlea 70 and base of the skull by bone conduction. The outer surface of the earphone is shaped to engage closely with the wearer's ear. In particular, the inner portion 440 is shaped to engage with the ear canal 40 inwardly of the first bend 60 of the ear. The bend portion 430 is shaped to engage with the first bend 60 of the ear. The portions of the body also correspond to different parts of the acoustic waveguide 305. The inner end 320 of the waveguide 305 is provided by an opening in the inner portion 440 of the body 360. The neck 340 at the bend 350 of the waveguide 305 is located in the bend portion 430 of the body 360. The outer end 315 of the waveguide 305 is provided by an opening in the outer portion 410 of the body 360. The outer portion 410 is designed so that the largest speaker possible can fit at the outer end 315 of the acoustic waveguide 305. The exterior surface of the outer portion 410 is shaped to match and engage with the incisura 18 and the concha 30. In this portion, the shape of the waveguide 305 approximates the shape of the cavum 32. A solid lobe 330 of silicone projects from the outer portion 410. This protruding lobe 330 is shaped to engage with the cymba 34.

The natural size and curves of the outer ear—in particular, the concha 30, dictate the size of speaker that can comfortably fit into the silicone body 360. A larger speaker allows more air to be pushed into the acoustic waveguide 305. The more air that can be pushed into the waveguide 305, the more powerful the vibrations that can be delivered to the ear.

In the middle portion 420 of the body 360, the waveguide 305 is designed to follow and accentuate the natural curves of the concha 30, leading to the curve at the first bend 60 of the ear canal 40. By carefully shaping the waveguide 305, the waveguide can control how the audio waves are delivered to the bend 350. Preferably, the shape of the waveguide 305 matches the shape of the ear canal 40 and can accentuate its audio-channeling properties. In the bend portion 430 of the silicone body 360, the bend 350 in the waveguide 305 passes through the neck 340, turning the audio waves towards the inner ear canal and ear drum 75. By carefully shaping the bend 350, the audio waves can expand towards the inner end 320 of the waveguide 305, in the inner portion 440 of the body 360. It is believed that this delivers the maximum amount of air and vibration in the clearest way possible. It is also believed that this makes bone conduction possible, via the inner portion 440 of the silicone body 360. Preferably, at the inner portion 440 of the body 360, the silicone vibrates against the skin of the ear canal 40 at the point where cartilage 65 is directly attached to the temporal bone 50. The vibrations created by the silicone and air can cause a secondary form of hearing, called bone conduction, through the mastoid and the temporal bones.

In some embodiments (not illustrated), the inner end of the body 320 of the waveguide 305 is slightly smaller than the part of the ear canal 40 which it fits into. Therefore, the part of the earphone between the bend 350 and the inner end 320 will not contact the skin of the user's ear canal when in use. This improves the comfort of the user whilst still allowing vibrations to be transmitted at the point where the cartilage 65 is directly attached to the temporal bone at the bend 350 of the waveguide 305. Since the inner end of the waveguide 305 is only slightly smaller than the part of the ear canal 40 into which it fits (e.g. 50%-99% of the size of that part of the ear canal or 50%-99% of the size of the smallest part of the ear canal in which the earphone lies), the waveguide 305 can still flare out (i.e. be tapered) to a significant degree to provide an improved sound quality as discussed above. The combination of the features described above results in an immersive sound experience that is unlike the experience provided by conventional earphones. It is believed that this results in part from the acoustic waveguide 305, in part from the close engagement between the exterior of the silicone body 360 with the skin of the ear 5 and—related to this—the coupling of vibrations to the inner ear through both air conduction (via the tympanic membrane 75) and bone conduction, through solid material to the cochlea and base of the skull.

FIG. 8 shows schematically how the earphone 300 fits into the ear 5. It also shows a cover 500, which fits over the transducer 310, covering the back of the transducer (speaker) 310. Air holes 510 are provided in the cover 500, to avoid creating a sealed enclosure between the rear of the diaphragm of the speaker and the cover 500. This helps to ensure that the speaker diaphragm can move as freely as possible, which can provide better speaker response. FIG. 9 shows schematically how sound waves 600 are believed to propagate in the acoustic waveguide 305, between the speaker 310 and the inner end 320 of the waveguide 305. The cover 500 can be attached to the speaker 310, to the silicone body 360, or to both.

The silicone body 360 is preferably customised to match the shape of the ear of one specific user. This can be achieved by moulding the silicone body 360 into that specific shape. There are a variety of ways to achieve this. One exemplary method will now be described. The method comprises, firstly, determining the shape of the ear and, secondly, producing the body 360 of the earphone so that the relevant parts of the exterior surface match the shape of the ear. In one example, the shape of the ear can be determined by taking an impression of the ear. The impression can be taken by inserting soft silicone into the ear. (Note that this is not the silicone that will be used to make the body 360.) Taking an ear impression in this way is known for the purpose of making custom hearing-aids. Having obtained the ear impression, there are several ways to manufacture the body 360 of the earphone. In one embodiment, the silicone ear impression is digitally scanned to create a 3D model on a computer. The 3D model can be used with a 3D printer to make a plastic mould. This mould is then filled with silicone to make the body 360. As described previously above, four different types of silicone, of different hardness, are used, for the outer portion 410, middle portion 420, bend portion 430, and inner portion 440, respectively. The result of the moulding process is a solid body of silicone. Silicone is then removed from the centre of this body, to create the audio waveguide 305.

The audio waveguide 305 can be designed in conjunction with the 3D model of the body 360, using computer 3D modelling software. In this case, the 3D model in the computer defines not only the exterior surface of the body 360, but also the interior surface, forming the acoustic waveguide 305. This model can be 3D-printed directly in silicone, using a suitable 3D printer. One such 3D printer is that manufactured by Picsima Ltd (a subsidiary of Fripp Design) of Sheffield UK. The Picsima printer is able to directly print silicone of different hardness at different locations within the body 360.

In another possible approach, instead of taking an ear impression to determine the shape of the ear, the ear may be digitally scanned directly, to measure its shape. This can allow a 3D computer model of the shape to be obtained directly from the ear, without the need for intermediate steps.

After the silicone body 360 has been prepared in the correct shape (including shaping the acoustic waveguide 305) the body 360 may be coated with a silicone impression lacquer to make the earphone more comfortable and reduce the sound absorption properties of the silicone. One suitable lacquer is the product known as Abdrucklack, produced by DETAX GmbH & Co. KG. This also acts as a silicone sealant, which protects the earphones.

In many users, the size and shape of the outer and middle ear will differ, between the left and right sides. Therefore, the exterior surface of the silicone body 360 should have a different size and shape for the left earphone as compared with the right earphone. In other words, the left earphone will have a body 360 whose shape is not merely a mirror image of the body 360 of the right earphone. Nevertheless, it is believed to be advantageous for the acoustic waveguide 305 to be substantially identically shaped, in both the left and right earphones. In particular, the acoustic waveguide 305 may be designed according to the size of the smaller ear and this size and shape can then also be adopted for the larger ear. It is believed that this helps to ensure a balanced perception of sound between the left and right ears.

With custom-shaped earphones having the features discussed above, it is possible to create a highly immersive sonic experience. Users using these earphones may experience the impression of sound coming from inside their head. There is an unmet need in the music, Virtual Reality (VR), film and television industries for a way to deliver immersive sound from portable devices like smart phones, tablets, laptops, and even home theatre. For example, it would be desirable to reproduce the perception of sounds that are "felt" as much as "heard", such as the loud rumble of a truck or the whistle of a Formula 1 race car passing by. It is believed that the phenomenon of bone conduction delivered through the cavum and inner ear, as discussed above, can be an effective way to deliver these vibrations which recreate the physical sensation of being there. For example, in respect of music reproduction, users have commented that it is better than being in the actual concert hall, because it feels as if you have become the musical instrument.

Whilst the earphones are preferably custom-shaped for an individual user as described above, in other embodiments the earphones may be provided as a combination of standardised interchangeable parts which may be sized differently. In this case, the user may be enabled to assemble a pair of earphones which best fits the size of their ear canals by selecting the appropriate standardised sizes of each (or some) of the components of the earphone. The available sizes may be chosen such that a limited number of interchangeable parts can be made available to meet the needs of a significant proportion of users. To achieve this, the available sizes may be chosen to match the average size of ear canal for different cohorts of users. To allow the user to select different sizes for different parts of the earphones, the earphones may be provided as a kit of parts. For example, a first part may house the acoustic transducer of the earphone together with a first portion of the acoustic waveguide 305 starting from the outer end, while a second portion may define the rest of the acoustic waveguide 305 up to the inner end. The user may then select the size of the first part of the earphone which best matches the size of the corresponding part of their ear canal. The user may then select the size of the second part of the earphone which best matches the size of that part of their ear canal. For example, three different sizes of each standardised part may be produced to suit small, medium and large ear canals respectively, although of course more or fewer numbers of different sizes of each standard part may be made available (and the numbers of different sizes may be different for each part). It will also be appreciated that the acoustic waveguide 305 of the earphones may be defined by more than two parts to allow more granular customisation of the earphones whilst still using standardised parts. Whilst the fit of such an earphone is unlikely to be quite as good as that of a custom-shaped earphone, a reasonable fit may still be provided for the majority of users whilst still producing the quality of sound resulting from the above-discussed enhancements. Meanwhile, this approach may provide significant reductions in manufacturing cost of the earphones.

Embodiments also have good sound-isolation properties—that is, an ability to attenuate or mask external or background sound while the audio transducer is in operation.

Embodiments may be used beneficially in any system relying on audible communications—in particular, those operating under conditions of loud background noise. For example, the invention may be applied to advantage in airline pilot communication systems.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practising the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An earphone, comprising:

an acoustic transducer; and an acoustic waveguide, for coupling sound waves from the acoustic transducer into an ear, the waveguide having an outer end and an inner end, at least the inner end being open, wherein the acoustic transducer is arranged at the outer end of the acoustic waveguide and the inner end of the acoustic waveguide is configured to be located in the ear, and wherein the acoustic waveguide has a neck between the outer end and the inner end, the acoustic waveguide having a cross section at the neck that is smaller than a cross section at each of the outer end and the inner end.

2. The earphone of claim 1, wherein the acoustic waveguide is tapered between the outer end and the neck and is tapered between the inner end and the neck.

3. The earphone of claim 1, wherein the acoustic waveguide comprises a cylindrical portion located between the outer end and the neck.

4. The earphone of claim 3, wherein the cylindrical portion starts at the outer end of the acoustic waveguide.

5. The earphone of claim 1, wherein the acoustic waveguide includes a bend.

6. The earphone of claim 5, wherein the neck is located at the bend.

7. The earphone of claim 1, wherein the earphone comprises a body formed of polymer material, and wherein the acoustic waveguide comprises a cavity in the polymer material.

8. The earphone of claim 7, wherein the acoustic transducer is mounted to an outer portion of the body.

9. The earphone of claim 8, wherein the body comprises:

a middle portion located inwardly of the outer portion;

a bend portion located inwardly of the middle portion; and an inner portion located inwardly of the bend portion.

10. The earphone of claim 9, wherein the bend of the acoustic waveguide is formed in the bend portion of the body.

11. The earphone of claim 7, wherein the body further comprises a protruding lobe for engaging with the cymba (cymba conchae) of a human ear.

12. The earphone of claim 7, wherein the body is formed of polymer material having different hardness at different portions of the body.

13. The earphone of claim 12, wherein at least one of the following conditions, or any combination of two or more of the following conditions, is met:

the outer portion is harder than each of the middle portion, the bend portion, and the inner portion;

the inner portion is softer than each of the outer portion, the middle portion, and the bend portion;

the middle portion is harder than the bend portion.

14. A pair of earphones comprising a left earphone and a right earphone, each according to claim 13, the shape of the acoustic waveguide in the left earphone being a mirror image of the shape of the acoustic waveguide in the right earphone, wherein the body of the left earphone is not a mirror image of the body of the right earphone.

15. A method of manufacturing a pair of earphones according to claim 14 comprising:

(i) manufacturing a left earphone of the pair of earphones by applying to an individual user's left ear canal the method comprising the steps of (a) determining the shape of an individual user's ear canal and (b) manufacturing the body of the earphone so that at least a part of the exterior of the body is substantially identical to said determined shape; and (ii) manufacturing a tight earphone of the pair of earphones by applying to the individual user's right ear canal the method comprising the steps of (a) determining the shape of an individual user's ear canal and (b) manufacturing the body of the earphone so that at least a part of the exterior of the body is substantially identical to said determined shape.

16. The method of claim 15, further comprising forming the shape of the acoustic waveguide for both of the earphones based on the smaller of the individual user's left and right ear canals.

17. The method of claim 15, wherein the size of the inner ends of the body of both earphones are the same.

18. The method of claim 17, wherein the inner ends of the body of both earphones are sized to be between 50% and 99% of the size of the corresponding cross-section of the smaller of the individual user's left and right ear canals.

19. The method of claim 17, wherein the inner ends of the body of both earphones are sized so that they are smaller than the size of the smallest cross section of the portions of both of the user's ear canals in which the body of each earphone lies when the pair of earphones are worn by the individual user.

20. The method of claim 19, wherein the inner ends of the body of both earphones are sized to be between 50% and 99% of the size of the smallest cross section.

21. The method of claim 17, wherein the inner ends of the body of both earphones are sized such that the outer surface of the body between the inner end and the bend of each earphone does not contact the skin of the individual user's respective ear canal.

22. The earphone of claim 7, wherein the polymer material comprises silicone.

23. A method of manufacturing an earphone according to claim 7, the method comprising the steps of:

(i) determining the shape of an individual user's ear canal; and (ii) manufacturing the body of the earphone so that at least a part of the exterior of the body is substantially identical to said determined shape.

24. The method of claim 23, wherein the step (ii) of manufacturing the body comprises sizing the inner end of the body so that it is smaller than the size of a corresponding cross-section of the individual user's ear canal in which the inner end of the body lies when the earphone is worn by the individual user, such that an outer surface of the inner end of the body does not contact the skin of the individual user's ear canal.

25. The method of claim 24, wherein the inner end of the body is sized to be between 50% and 99% of the size of the corresponding cross-section of the individual user's ear canal.

26. The method of claim 24, wherein the inner end of the body is sized so that it is smaller than the size of the smallest cross section of the portion of the user's ear canal in which the body lies when the earphone is worn by the individual user.

27. The method of claim 26, wherein the inner end of the body is sized to be between 50% and 99% of the size of the smallest cross section.

28. The method of claim 24, wherein the inner end of the body is sized such that the outer surface of the body between the inner end and the bend does not contact the skin of the individual user's ear canal.

29. The method of claim 23, wherein the step (ii) of manufacturing the body comprises at least one of:

3D printing a mould for moulding the polymer material; and 3D printing the polymer material.

30. A kit of parts for assembly into an earphone according to claim 1.

31. The kit of parts of claim 30, wherein the kit comprises:

a first part housing the acoustic transducer and defining a first portion of the acoustic waveguide including the outer end; and a second part defining a second portion of the acoustic waveguide including the inner end.

32. The kit of parts according to claim 31, for assembly into an earphone comprising:

an acoustic transducer; and an acoustic waveguide, for coupling sound waves from the acoustic transducer into an ear, the waveguide having an outer end and an inner end, at least the inner end being open, wherein the acoustic transducer is arranged at the outer end of the acoustic waveguide and the inner end of the acoustic waveguide is configured to be located in the ear, and wherein the acoustic waveguide has a neck between the outer end and the inner end, the acoustic waveguide having a cross section at the neck that is smaller than a cross section at each of the outer end and the inner end, wherein the acoustic waveguide comprises a cylindrical portion located between the outer end and the neck, and wherein the first portion of the acoustic waveguide defined by the first part includes the cylindrical portion.

33. The kit of parts according to claim 31, wherein the kit further comprises a third part for engaging with the outer ear of a wearer to secure the earphone in place when in use.

* * * * *